US011006714B2

(12) United States Patent
Gaye

(10) Patent No.: US 11,006,714 B2
(45) Date of Patent: May 18, 2021

(54) COMPACTIBLE REUSABLE SHOPPING BAG

(71) Applicant: Joseph O. Gaye, Highlands Ranch, CO (US)

(72) Inventor: Joseph O. Gaye, Highlands Ranch, CO (US)

( * ) Notice: Subject to any disclaimer, the term of this patent is extended or adjusted under 35 U.S.C. 154(b) by 11 days.

(21) Appl. No.: 16/660,545

(22) Filed: Oct. 22, 2019

(65) Prior Publication Data

US 2021/0112937 A1 Apr. 22, 2021

(51) Int. Cl.
*A45C 3/00* (2006.01)
*A45C 3/04* (2006.01)
*A45C 7/00* (2006.01)

(52) U.S. Cl.
CPC ..... *A45C 3/04* (2013.01); *A45C 3/001* (2013.01); *A45C 7/0077* (2013.01)

(58) Field of Classification Search
CPC ..... A45C 3/04; A45C 3/3001; A45C 7/0077
USPC ..... 383/6
See application file for complete search history.

(56) References Cited

U.S. PATENT DOCUMENTS 3,132,794 A 5/1964 Frazier
4,062,392 A 12/1977 Ishii
4,781,278 A * 11/1988 Sadow ..... A45C 3/001 190/107
4,951,818 A * 8/1990 Johnson ..... A45C 5/14 190/107
5,024,344 A 6/1991 Paula
5,046,860 A 9/1991 Brennan
5,086,888 A * 2/1992 Chu ..... A45C 7/0036 190/107
5,620,069 A * 4/1997 Hurwitz ..... A45C 3/00 190/107
5,813,445 A 9/1998 Christman
5,988,878 A * 11/1999 Simonett ..... B62J 9/00 383/119
6,224,261 B1 * 5/2001 Stone ..... B65D 88/1625 220/9.2
7,451,861 B2 * 11/2008 Bhavnani ..... A45C 7/0077 150/113
7,575,117 B2 * 8/2009 Redzisz ..... A45C 7/0036 206/373
7,621,305 B2 11/2009 Cho
7,958,920 B1 6/2011 Olsson
8,011,500 B2 9/2011 Lee
8,132,601 B2 * 3/2012 Wang ..... B65D 31/12 150/113
8,287,188 B2 10/2012 Hoyord et al.
(Continued)

*Primary Examiner* — Peter N Helvey
(74) *Attorney, Agent, or Firm* — Williams Intellectual Property; Benjamin F. Williams

(57) ABSTRACT

A compactible reusable shopping bag devised to incentivize reuse is presented herein. The compactible reusable shopping bag is compactible down to a discrete, folded stack enabling ready storage and portage when not in use. The compactible reusable shopping bag is securable in the folded stack by securement of a pair of handles around the folded stack and, in an alternative embodiment, by action of fasteners. The compactible reusable shopping bag further includes handle loops enabling carriage of fewer items in the bag and attachment of a shoulder strap to enable over-the-shoulder carry when at capacity. The compactible reusable shopping bag is lightweight, capacious, and durable.

19 Claims, 17 Drawing Sheets

(56) References Cited

U.S. PATENT DOCUMENTS

| | | | | |
|---|---|---|---|---|
| D779,828 | S | 2/2017 | Cronkshaw | |
| 2005/0196080 | A1* | 9/2005 | Stone | B65D 88/1631 383/119 |
| 2006/0201979 | A1 | 9/2006 | Achilles | |
| 2007/0025647 | A1* | 2/2007 | Hamlin | B25H 3/00 383/14 |
| 2010/0014785 | A1 | 1/2010 | Deck | |
| 2010/0084443 | A1 | 4/2010 | Adelman | |
| 2010/0200450 | A1 | 8/2010 | Weed | |
| 2011/0176750 | A1 | 7/2011 | Keller | |
| 2014/0169705 | A1* | 6/2014 | Schinasi | B65D 33/02 383/119 |
| 2016/0262509 | A1 | 9/2016 | Chaffee et al. | |

* cited by examiner

COMPACTIBLE REUSABLE SHOPPING BAG

BACKGROUND OF THE INVENTION

Single-use plastic bags have become an environmental scourge. With many municipalities, counties, states, and even countries moving to ban single-use plastic bags, or at least tax them to disincentivize their use, reusable bags for shopping are ever more popular.

Reusable bags seek to combine capacity with durability for repeated use, while remaining cost effective to produce and distribute. However, an inconvenience results where shoppers have to bring their own bags with them on their shopping errands, or else buy a new reusable bag or succumb to using plastic again. Reusable shopping bags are typically left in vehicles, therefore, often in an untidy heap or pile in the trunk, in the footwells, or elsewhere in the vehicle. Such storage exposes bags to uneven wear and tear, diminishing their longevity, and creates a messy appearance in the user's vehicle. Neither do reusable bags presently seen in the art store conveniently or compactly when not in use; rather, they are typically hung up by their handles from an elevated surface or projection or stuffed one inside another. Such a situation can make retrieving a particular bag hasslesome.

The present compactible reusable shopping bag, therefore, seeks to incentivize reuse by combining durable, lightweight materials into a compactly foldable form that is convenient for storage in a user's vehicle; such as tidily stored in the glovebox or seatback pocket, in other bags, or ported upon the person; or tidily stacked elsewhere in the home or garage. The present compactible reusable shopping bag combines lightweight durable materials and a foldable form that is securable in a folded stack that is approximately less than an inch thick with a profile area of approximately one-third the area of one of the bag's longitudinal sides when the bag is deployed in an expanded position. The present compactible reusable shopping bag further presents three novel modes of carriage, enabling versatility when porting different quantities and different types of goods.

FIELD OF THE INVENTION

The present invention relates to a compactible reusable shopping bag devised to compactly fold down to a folded stack approximately one-third the area of one of the bag's longitudinal sides when in the expanded position. The present compactible reusable shopping bag has been devised to match a large capacity in-use with multiple means of porting items—fewer items may be ported in the bag by a user holding a pair of handle loops, for example. At full capacity the bag can be ported over the shoulder by addition of a shoulder strap. Items may be ported in the bag by a user carrying the bag by a pair of handles in a typical fashion. The bag is thus adaptable to carry fewer or more items, despite the bag's intentionally large capacity.

The present compactible reusable shopping bag has been devised of lightweight, durable polymers to resist degradation over time with repeated use carrying heavy and edged items (such as, for example, tins and cans of foodstuffs, groceries, books, and other such items as are frequently purchased and brought into the home). The present compactible reusable shopping bag further comprises materials devised to resist degradation by exposure to the elements, such as temperature variations, direct sunlight, and weather, as will often occur with repeated use in and out of the home and when left, for example, visibly exposed in a vehicle.

The present compactible reusable shopping bag further compacts down into a conveniently storable folded stack. Reinforcing elements disposed within or upon the bag's transverse sides are stackable atop one another when each transverse side is folded inwards along a vertical fold. The bag is then foldable by action of a Z-fold or a U-fold, in various embodiments, into a stack having an area approximately one-third the area of one of the longitudinal sides when expanded. The reinforcing elements enable securement of the bag in the folded stack and provide a stiff basis for purchase when folding the bag and when storing it (such as, for example, when sliding it into and out of a seat pocket). In example embodiments, the bag is securable in the folded stack by action of the handles engaged around the stack. In another embodiment the stack is securable folded together by action of fasteners disposed to engage the stack together.

Thus, the present invention presents a compactible reusable shopping bag devised to incentivize reuse on shopping trips wherein various items and quantities of items are desirously purchased and ported home.

SUMMARY OF THE INVENTION

The general purpose of the compactible reusable shopping bag, described subsequently in greater detail, is to provide a convenient and readily storable reusable shopping bag, to incentive reuse of said shopping bag, and enable compact storage in a vehicle, in the home, or upon the person. The present compactible reusable shopping bag further provides three distinct modes of carriage for use when porting differing quantities of items or for convenience when porting different items.

It is well known that plastic bags have become an environmental scourge. Plastic bags are now found in every ocean on Earth and comprise banks of drifting trash that cover tens of thousands of square miles. The great pacific garbage patch alone is estimated to be twice the size of Texas, or three times the size of France. Presently it is estimated that anywhere from 1.15 to 2.41 million metric tons of plastic waste enters the oceans annually.

Many municipalities, counties, states, and even countries are moving to ban single-use plastic bags or at least tax or disincentivize their usage by means of a surcharge. Reusable bags are now encouraged for shoppers everywhere. A principal issue with reusable bags, however, is neglecting to bring them on the shopping errand, thereby necessitating payment for a plastic bag or the purchase of another reusable bag. Additionally, the shape and form of most reusable bags seen in the art makes storing them tidily nearly impossible, and heaps of bags typically litter the inside of people's vehicles. Bags are also stuffed unceremoniously inside other bags. Uneven wear, wrinkling, entanglement, and other such issues generally arise requiring repurchase of a new, reusable shopping bag. This rather defeats the purpose and intent of a reusable bag; longevity should be a primary characteristic; and easy storage for use and reuse should be enabled to incentivize adoption.

The present invention, therefore, seeks to incentivize use of reusable shopping bags by providing a compactible reusable shopping bag that folds down to a compact, folded form, comprising a discrete unit convenient for storage in the vehicle or on the person. Additionally, the compact folded position of the present bag enables storage of multiple bags without sacrificing too much space in the glove box, say, in the trunk, or elsewhere in the vehicle (such as seat pockets, for example). A user is readily apprised of how many bags are available because the folded bag occupies a discrete, visually determinable unit, herein termed a "stack". The bag includes a stiffness, imparted by reinforcing elements in or upon the transverse sides, enabling purchase and position of the bag, such as when sliding the stack into a seat pocket, for example, or stacking stacks together in another bag or in the glove box, say.

By providing a compact, storable reusable shopping bag, foldable into a discrete stack, keeping a plurality of bags in the vehicle or in another shopping bag, for example, is incentivized and facilitated whereby a user has a reusable shopping bag at hand when necessary. Such a bag must be lightweight, readily portable yet durable and strong enough to repeatedly port groceries and/or other goods over space and time as well as persist over prolonged exposure to the elements (such as being left in direct sunlight, for example, in a user's vehicle).

The present compactible reusable shopping bag, therefore, has been devised to maximize portability, volume, capacity, durability, and compactability, and has been devised to be foldable down to a folded stack that occupies an area one-third the size of the bag profile and less than 1" to 1.5" thick. The bag is devised to be lightweight, yet strong enough to hold and suspend a quantity of groceries and/or other goods filling its capacity (including edged and hard goods, such as tins and cans, for example), and to be durable enough to withstand multiple uses and exposure to weather during use and storage. The compactible reusable shopping bag is contemplated to be made of a lightweight, durable, impermeable polymeric fabric such as silnylon, polyester coated with polyurethane, or polyethylene, or a laminated woven sheet material, or other lightweight, durable, impermeable material.

For the purposes of this disclosure, a "Z-fold" is taken to be a type of fold that folds a body into a stack of thirds, with each of a first third and a final third being folded in opposite directions to overlie and underlie a central third respectively.

A "U-fold", conversely, is taken to be a type of fold that folds a body into a stack of thirds by folding each of a first third and a final third atop a central third by folding in the same direction.

The compactible reusable shopping bag set forth herein includes an open top and a bottom perimetrically bounded by a plurality of sides disposed to surround an interior space. For simplicity of description, the plurality of sides comprises an outside surface, an inside surface, and a height. The plurality of sides further comprises a pair of longitudinal sides and a pair of transverse sides. To enable compact folding down to the folded stack, as will be described subsequently, each of the pair of transverse sides is two-thirds the length of each of the pair of longitudinal sides.

Each of the pair of longitudinal sides includes a first vertical fold disposed between the open top and the bottom approximately one-third of the length along each said longitudinal side. A second vertical fold is likewise disposed between the open top and the bottom at approximately two-thirds of the length of each said longitudinal side. The first vertical fold and the second vertical fold thus partition each longitudinal side into thirds—a first third, a central third, and a final third—and enable, in one embodiment, a Z-fold of the longitudinal sides to stack the thirds compactly together, as will be described hereinbelow; and in another embodiment, a U-fold to stack the thirds compactly together, as will also be described hereinbelow.

Each of the pair of transverse sides is two-thirds the length of each of the pair of longitudinal sides. Each transverse side is bisected by a vertical fold disposed from the open top to the bottom. Each transverse side includes a pair of reinforcing elements disposed reinforcing each transverse side; one of said pair of planar reinforcing elements disposed on either side of the vertical fold. Each of the transverse sides is therefore foldable inwards, so that the outside surface of each of the two halves is caused to contact each other, whereby the pair of reinforcing elements is therefore stacked together.

Folding the transverse sides inwards stacks each pair of reinforcing elements together and creates firm planar areas sandwiched in between the first thirds and the final thirds of the longitudinal sides around which to fold the longitudinal sides and, ultimately, in at least one example embodiment, to engage the handles when securing the bag in the folded stack.

The collapsed transverse sides therefore create rigid areas usable in at least one embodiment to effectuate the Z-fold of the longitudinal sides and position the reinforcing elements stacked together with the central third in between the first and final thirds. Alternatively, the collapsed transverse sides create rigid areas usable to effectuate the U-fold, disposing the first and final third atop the central third. In such embodiments, the bag is collapsed and folded into a planar area one-third the size of the bag's profile. The bag is then secured tautly in this folded position by action of the bag's handles, as will be described below, engaged around the stack and secured by connection at the bottom of the folded stack or, alternatively, by action of fasteners disposed to secure the stack in the folded position, as will be described subsequently. The reinforcing elements thus maintain a useful rigidity that is redoubled by stacking the said reinforcing elements together, first by folding each transverse side inward, and second by folding the bag in either a Z-fold or a U-fold to stack all the reinforcing elements atop one another. Thus, the rigidity of the stack is approximately four times as rigid as the transverse sides when in the expanded position.

For portage, the bag includes a pair of handles and a pair of handle loops, adapted for porting the bag in separate ways; and, in the case of the handles, in an example embodiment contemplated herein, for securing the bag in the folded position by securement of the handles tautly engaged around the folded stack and engaged at the stack's folded bottom.

In one embodiment, then, each of the pair of handles has a length approximately twice the height of the plurality of sides. In this instance, the handles are contemplated to secure the bag and maintain its position in the folded stack in a plurality of ways. In one embodiment, each of the pair of handles is connected to both of the pair of longitudinal sides at the open top in parallel to the transverse sides. One of the handles is attached to each longitudinal side atop the first third, proximal the first vertical fold, and the other of the handles is attached to each longitudinal side atop the final third, proximal the second vertical fold. When the bag is folded to the folded stack, therefore, one end of each handle is necessarily disposed on the outermost portions of the folded stack, and the other end of each handle is disposed on one side of the central third folded interiorly within the folded stack. This enables securement of the bag in the folded position by engagement of the handles inverted around the stack, engaged at the bottom edge of the folded stack. Thus, additional to facilitating carriage of the bag, in this and other example embodiments, the pair of handles is usable to secure the bag in the folded position for compact storage and portage before and after use.

In another embodiment, each of the pair of the handles is disposed upon one of the pair of longitudinal sides at the open top, in parallel with the longitudinal sides. In this embodiment, the handles engage around the folded stack by diagonally wrapping around opposite sides of the folded stack and engage cornerwise at the stack's folded bottom. In another embodiment contemplated (but not shown), the handles are engaged at the bottom of the folded stack by attachment to an attachment member, such as a hook and loop fastener, for example, or other fastener. In this embodiment, the handles are turned 180° to engage against the attachment member disposed at the bottom edge of the folded stack. Additional means of utilizing the handles to secure the folded stack tightly are contemplated as part of this invention.

In still another example embodiment, use of the handles to secure the bag in the folded stack is omitted, and a first and second fastener are disposed to engage with each of a respective first and second fastening receiving element. The stack is formable by folding in each of a Z-fold and a U-fold, depending on the type of securement intended (i.e. engagement of the handles or use of fasteners and fastening receiving elements) as will be detailed hereinbelow in discussion of the accompanying drawings.

The pair of handle loops is disposed upon the pair of transverse sides at the open top. The pair of handle loops comprises a second length. Each of the pair of handle loops is devised to enable convenient portage of the bag when containing few items. Porting the bag by the handle loops effectively brings the transverse sides together and encloses the open top by fanning out the longitudinal sides. This creates a more compact carry that positions the bag in such a way as to prevent significant movement of fewer items ported therein. The handle loops are also connectable to a shoulder strap enabling over-arm carriage, when desired, as for example when carrying a lot of items at the bag's capacity. This is particularly useful for users who walk to the store, such as users who live in urban areas and forgo use of private vehicles.

It is further contemplated that, in some embodiments, the instant compactible reusable shopping bag is reversible and usable inside-out. In such embodiments, the instant compactible reusable shopping bag may incorporate bold designs and slogans displayable when the bag is used outside-out and inside-out. Further, in at least some embodiments contemplated herein, the present compactible reusable shopping bag is contemplated to be machine washable.

Thus, has been broadly outlined the more important features of the present compactible reusable shopping bag so that the detailed description thereof that follows may be better understood and in order that the present contribution to the art may be better appreciated.

Objects of the present compactible reusable shopping bag, along with various novel features that characterize the invention are particularly pointed out in the claims forming a part of this disclosure. For better understanding of the compactible reusable shopping bag, its operating advantages and specific objects attained by its uses, refer to the accompanying drawings and description.

BRIEF DESCRIPTION OF THE DRAWINGS

Figures

DETAILED DESCRIPTION OF THE DRAWINGS

Figure 1:
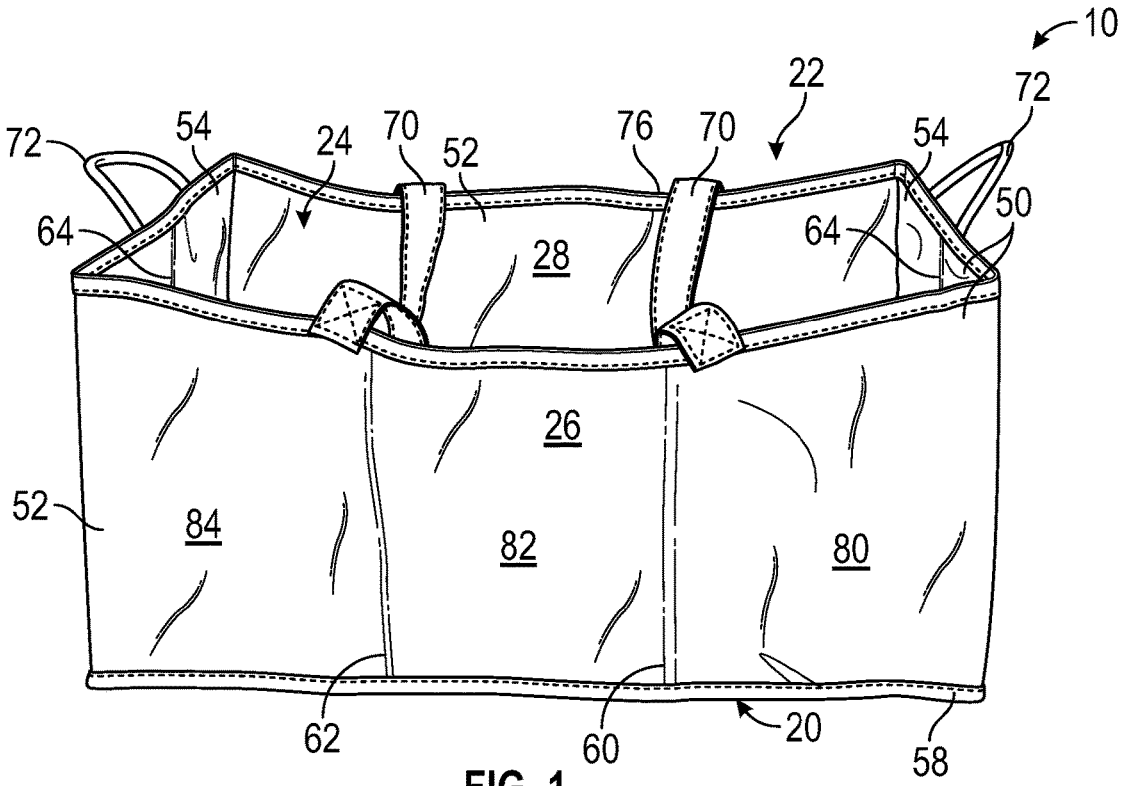
FIG. 1 is a perspective view of a longitudinal side of an example embodiment of the compactible reusable hopping bag.

With reference now to the drawings, and in particular FIGS. 1 through 27 thereof, example of the instant compactible reusable shopping bag employing the principles and concepts of the present compactible reusable shopping bag and generally designated by the reference number 10 will be described.

The compactible shopping bag 10 is collapsible to a folded stack 100 for compact storage and portage. Several example embodiments of the instant compactible reusable shopping bag 10 are contemplated and illustrated herein. In all embodiments depicted herein, the compactible reusable shopping bag 10 includes a bottom 20, an open top 22, and a plurality of sides 50 (comprising a pair of longitudinal sides 52 and a pair of transverse sides 54) bounding an interior space 24. In all embodiments, the bag 10 is made of a lightweight, impermeable polymer such as silnylon, polyester coated with polyurethane, or polyethylene, or of a laminated woven sheet material, or other lightweight, durable, and impermeable polymer. The purpose of the material is to render a lightweight, portable, durable fabric that is impermeable to liquids and long-lasting with repeated usage.

The bag 10 further includes an outside surface 26 and an inside surface 28. A pair of handles 70 is disposed, in alternative embodiments, spanning the open top 22 attached endwise to each of the pair of longitudinal sides 52 in parallel with the transverse sides 54 (see for example FIGS. 1 through 6) and, in an another embodiment, disposed longitudinally upon each of the pair of longitudinal sides 52 (as shown for example in FIGS. 9 and 10). The handles 70 have a length approximately twice the height of the bag 10. As will be shown, the position of the pair of handles 70 upon the longitudinal sides 52 affects how the bag 10 is securable in a folded stack 100 by engagement of the pair of handles 70 wrapped around the folded stack 100.

A pair of handle loops 72 is also included to enable carriage of the bag with fewer items therein and for interconnection with a shoulder strap 74 when porting the bag at capacity. One of the said pair of handle loops 72 is disposed upon each transverse side 54 at the open top 22. The pair of handle loops 72 enables carriage of the bag 10 in an alternative manner (see for example FIG. 7), useful when the bag 10 contains fewer items, for example, and alternatively the pair of handle loops 72 may be employed to port the bag 10 over the shoulder by interconnection with a shoulder strap 74 (see for example FIG. 27). Each of the pair of handle loops 72 is disposed connected at the reinforced topmost seam 56 to resist separation over prolonged use of the bag, particularly when frequently porting items long distances.

In all embodiments, the transverse sides 54 include a vertical fold 64 disposed bisecting each said transverse side 54 from the open top 22 to the bottom 20. Each said vertical fold 64 is disposed to fold inwards, into the interior space 24, to collapse the bag 10 transversely by folding the transverse sides 54 in half and causing the pair of longitudinal sides 52 to approximate each other. A pair of reinforcing elements 66 is disposed upon (or within) each transverse side 54, one of the said pair of reinforcing elements 66 disposed on either side of the vertical fold 64. These reinforcing elements 66 may be planar in extent, approximately half the size of each transverse side 54, and collectively provide purchase to enact the folding of the bag 10 to the folded stack 100 thereabouts and to secure the stack 100 by action of the handles 70 as will be described subsequently.

The transverse sides 54 are proportionately two-thirds the size of the longitudinal sides 52. When the transverse sides 54 are folded in half, therefore, and the bag 10 is collapsed across the interior space 24 to bring the longitudinal sides 52 in close proximity (see for example FIG. 8), the folded transverse sides 54 present an area one-third the size of the longitudinal sides 52. Folding the transverse sides 54 in half stacks the reinforcing elements 66 disposed on (or within) each transverse side 54 atop each other and provides a stiff basis for folding the bag 10 into the folded stack 100 by action of a Z-fold or, alternatively, a U-fold. Further, the reinforcing elements 66, when stacked together in the manner described, provide a level of stiffness of the folded stack 100 that enables securement of the bag 10 in the folded stack 100 by securement of the pair of handles 70 tautly engaged thereabouts, as will be set forth hereinbelow. It should be noted that alternative embodiments of the present compactible reusable shopping bag 10 present varied means of securement of the bag 10 in the folded stack 100 for compact storage and portage, as will be set forth hereinbelow.

Folding of the compactible reusable shopping bag 10 into the stack 100 is accomplished in one of two ways: by action of a Z-fold or a U-fold, depending on the embodiment contemplated. Some embodiments are foldable in either manner, however it is to be noted that the type of fold (either Z-fold or U-fold) effects the manner in which the pair of handles 70 secure the folded stack 100 in the folded position depending on which orientation of handles 70 is practiced as part of the invention.

As shown in FIGS. 18 through 25, in at least one embodiment contemplated herein, the bag 10 is securable in the folded stack 100 by action of fasteners 90, 92 disposed to secure around the transverse edges of the folded stack 100. In this at least one embodiment, the position of the fasteners 90, 92 dictates the type of fold employed to present the folded stack 100.

Figure 2:
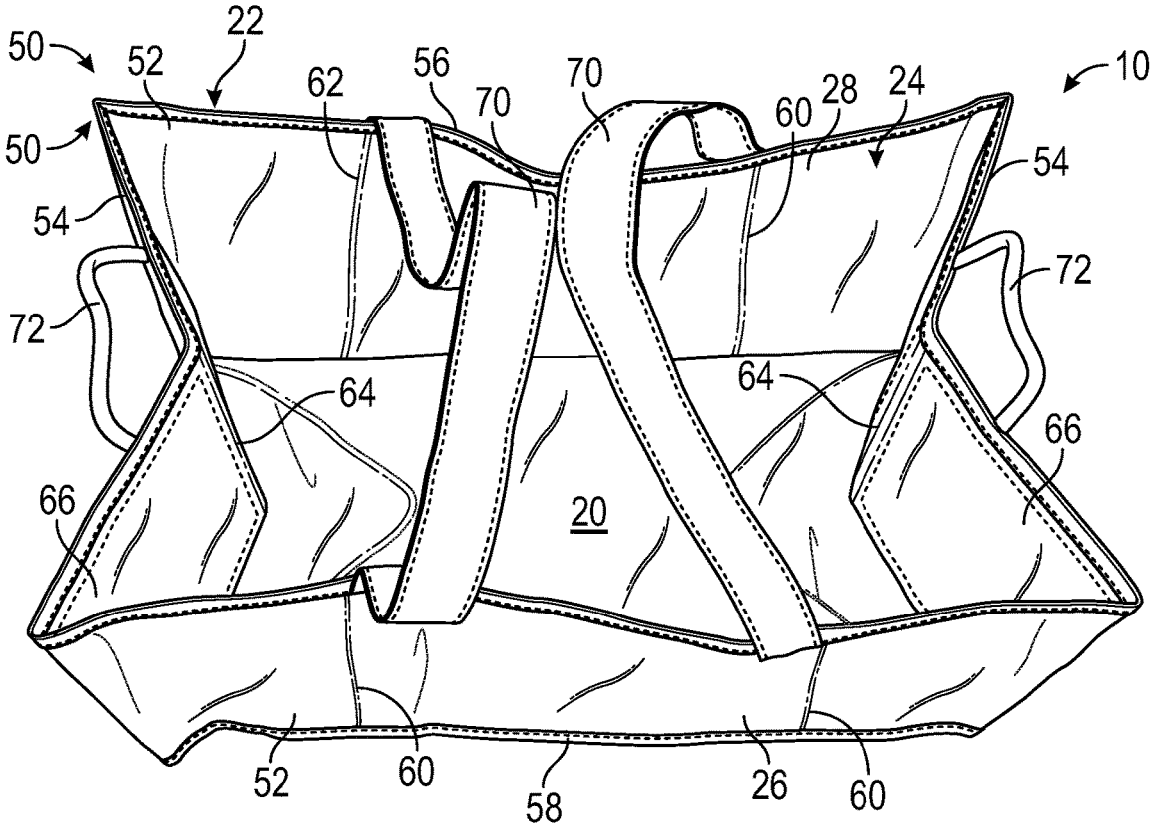
FIG. 2 is a top perspective view of an example embodiment showing each of a pair of handles attached in a transverse orientation.
Figure 3:
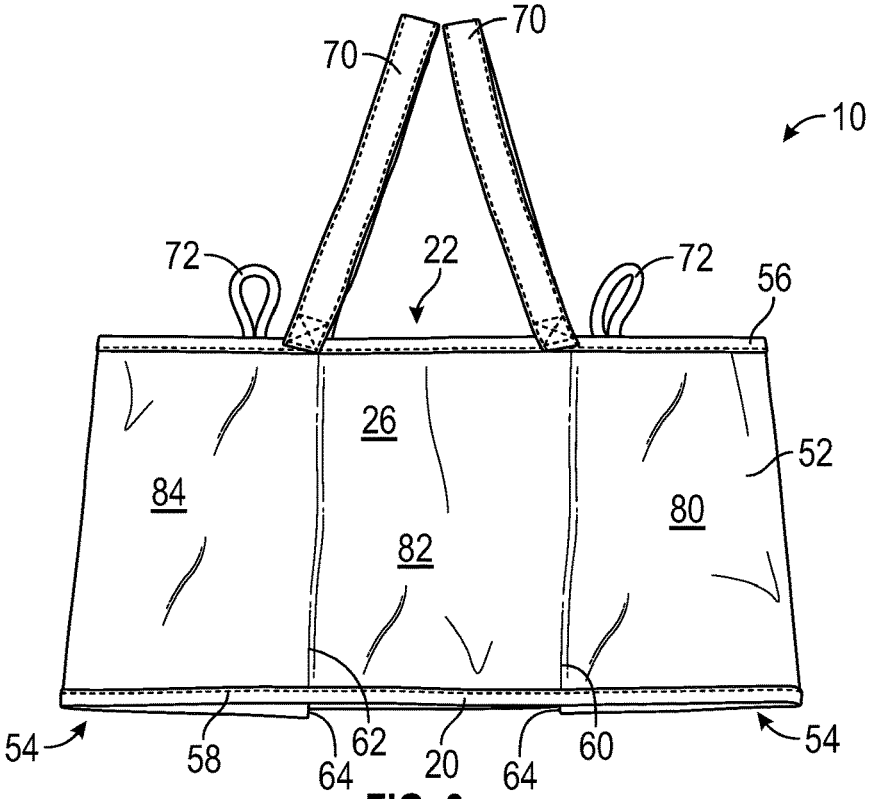
FIG. 3 is a side elevation view of an example embodiment of the compactible reusable shopping bag flattened with each of a pair of transverse sides folded inwards.
Figure 4:
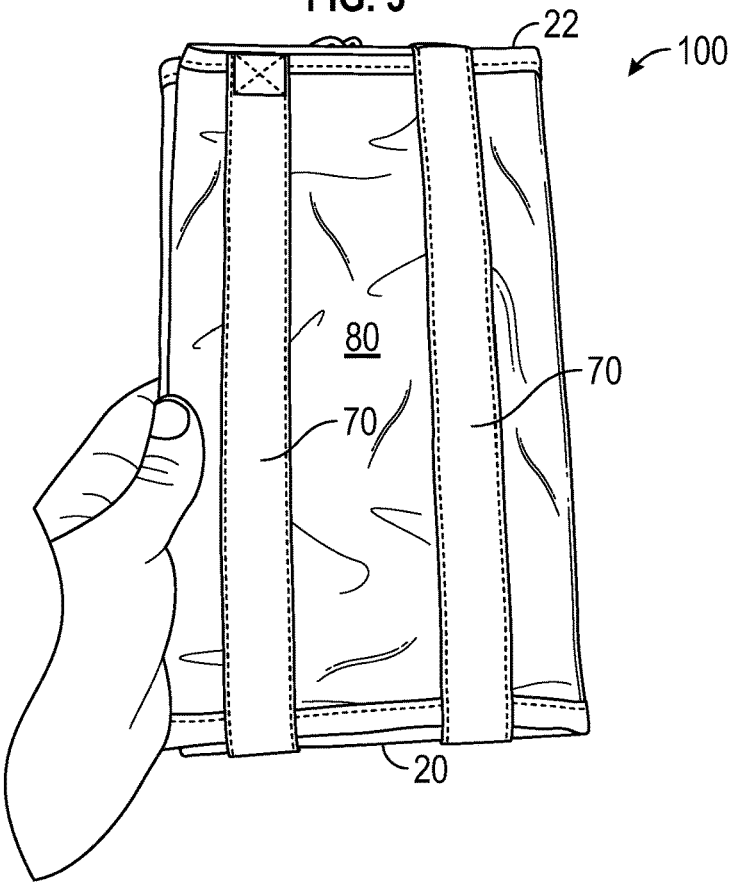
FIG. 4 is an elevation view of an example embodiment of the compactible reusable shopping bag secured in a folded stack by engagement of a pair of handles around the folded bottom of the stack.
Figure 5:
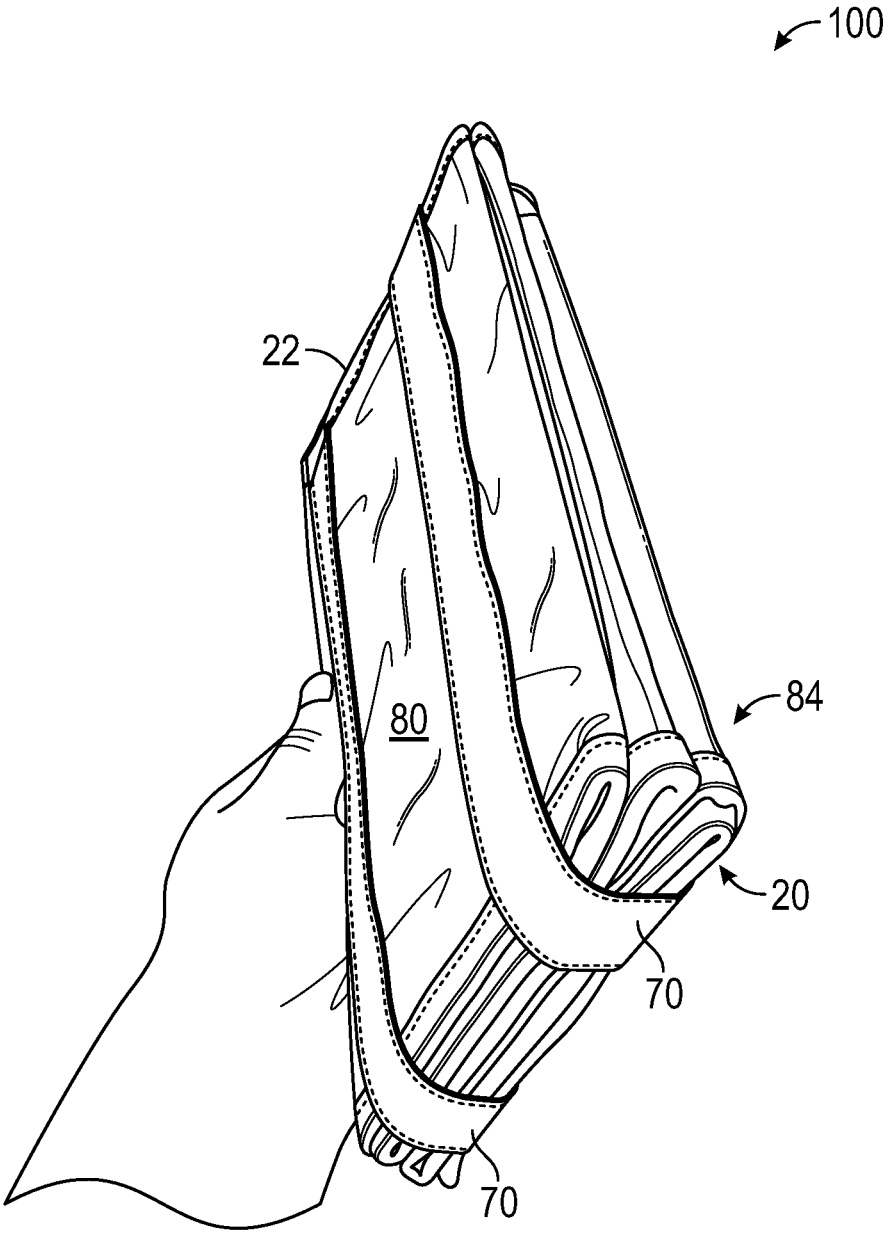
FIG. 5 is an elevation view of an example embodiment of the compactible reusable shopping bag secured in a folded stack by engagement of a pair of handles around the folded bottom of the stack.
Figure 6:
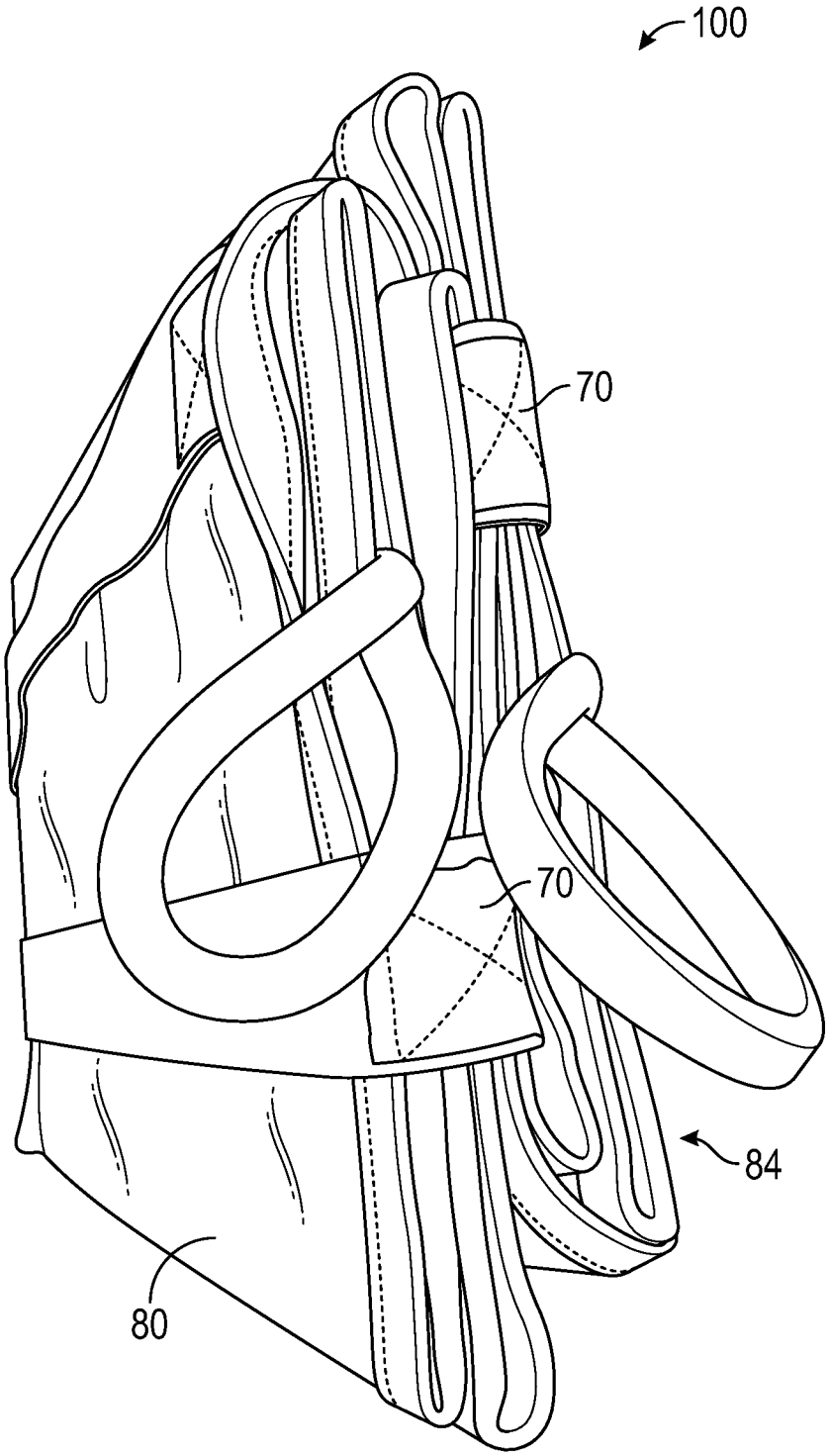
FIG. 6 is an elevation view of an example embodiment of the compactible reusable shopping bag secured in a folded stack by engagement of a pair of handles around the folded bottom showing each handle enwrapping one-half of the top of the folded stack.
Figure 8:
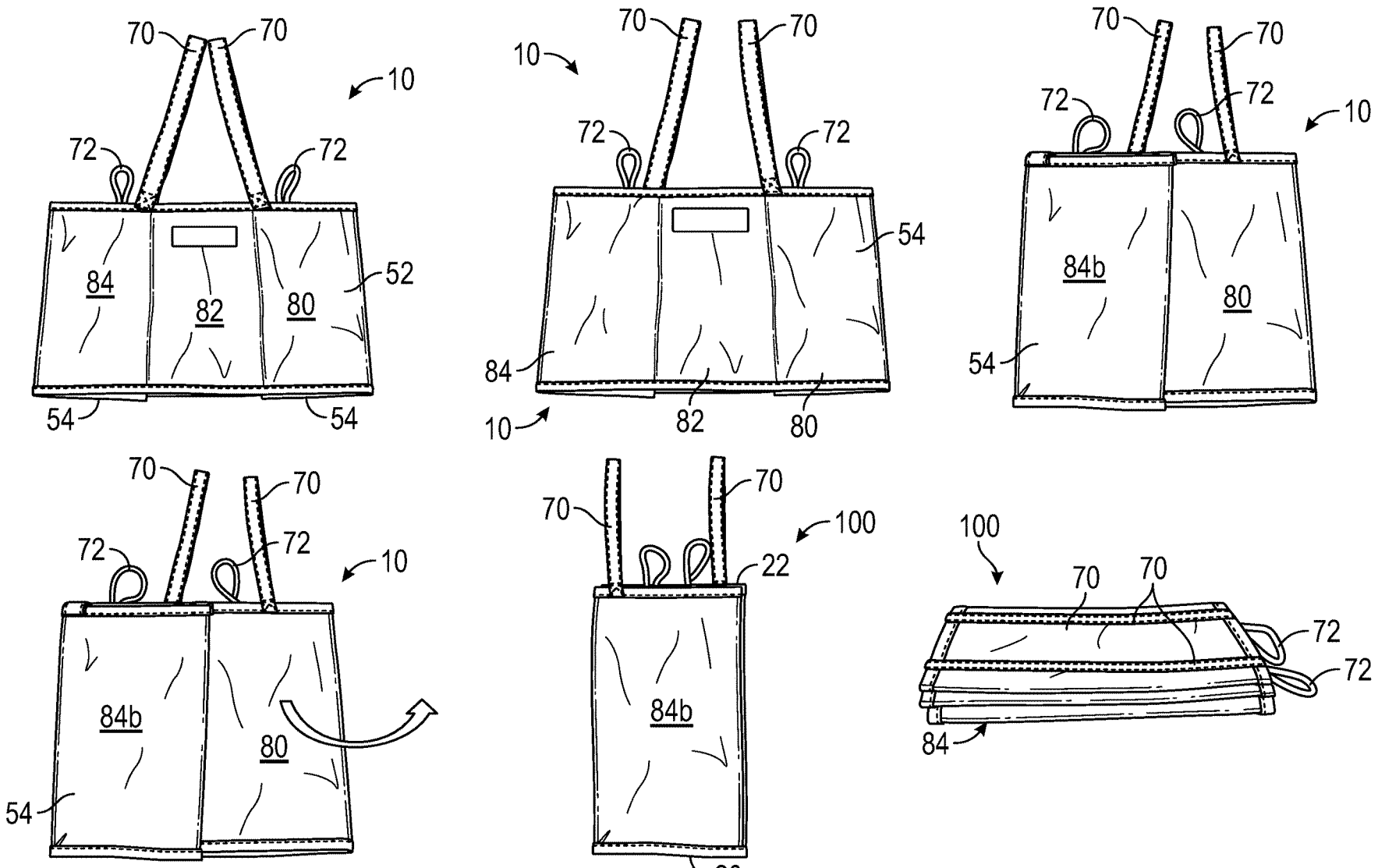
FIG. 8 is an elevation view illustrating effectuating a Z-fold of an example embodiment, from an expanded position to the folded stack approximately one-third the area of the bag's profile.

Referring now to FIGS. 1 through 6, an example embodiment of the present compactible reusable shopping bag 10 is illustrated having each of the pair of handles 70 attached to each of a pair of longitudinal sides 52 in parallel with a pair of transverse sides 54. That is, the pair of handles 70 is oriented transversely spanning the open top 22. As shown in FIGS. 4, 5 and 6, with the pair of handles 70 disposed oriented transversely spanning the open top 22, and connected endwise to each longitudinal side 52, the compactible shopping bag 10 may be secured in the folded stack 100 with each of the pair of handles 70 inverted and engaged around the folded bottom of the stack 100 in parallel. As shown in FIG. 8, in contemplating this embodiment, the bag 10 is folded into thirds by a Z-fold to form the folded stack 100. The pair of handles 70 is then inverted to secure around the folded bottom of the stack 100 and maintain the bag in the folded position.

Figure 10:
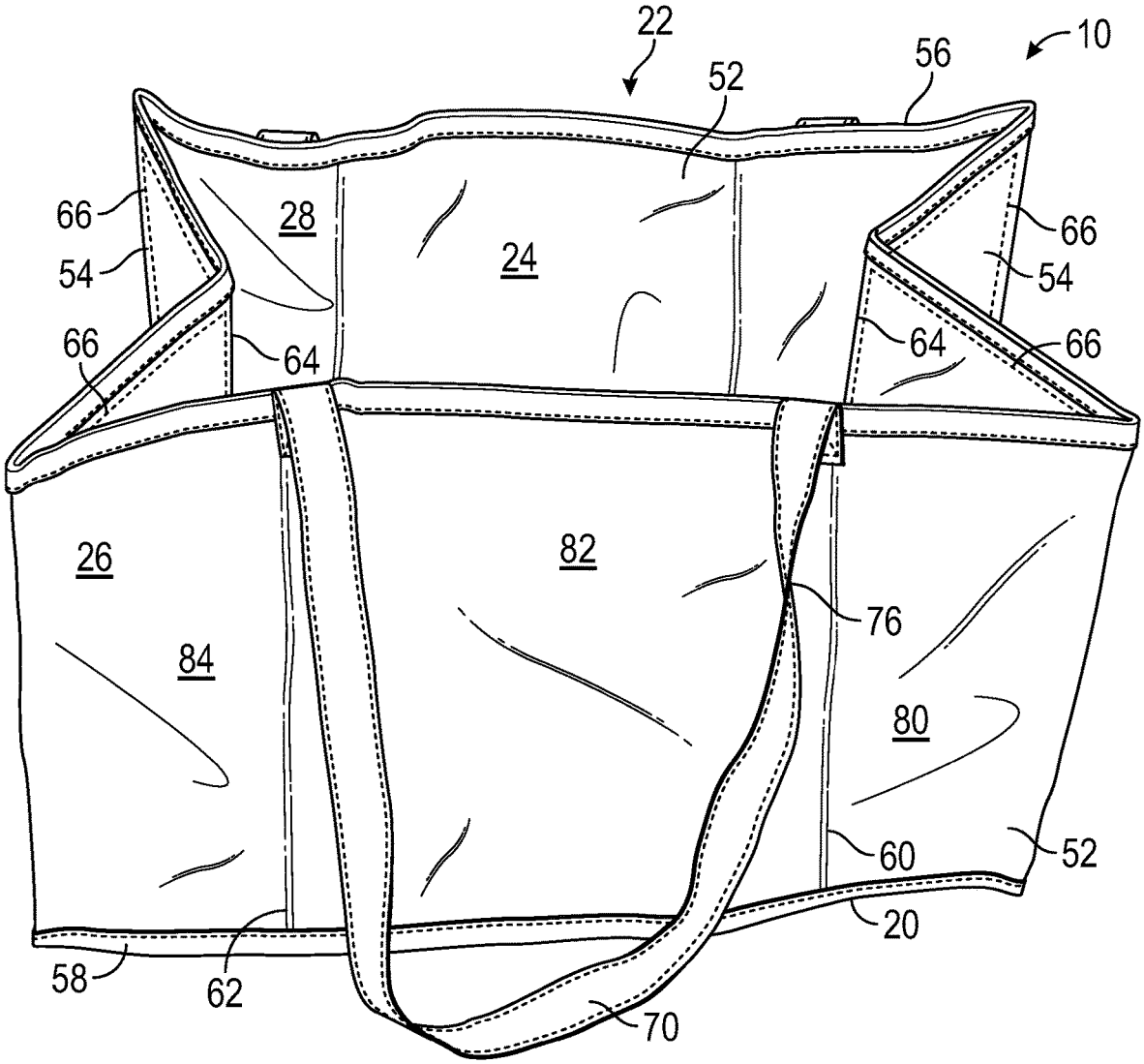
FIG. 10 is a perspective view of an example embodiment of the compactible reusable shopping bag having each of the pair of handles disposed attached to one of the pair of longitudinal sides.
Figure 11:
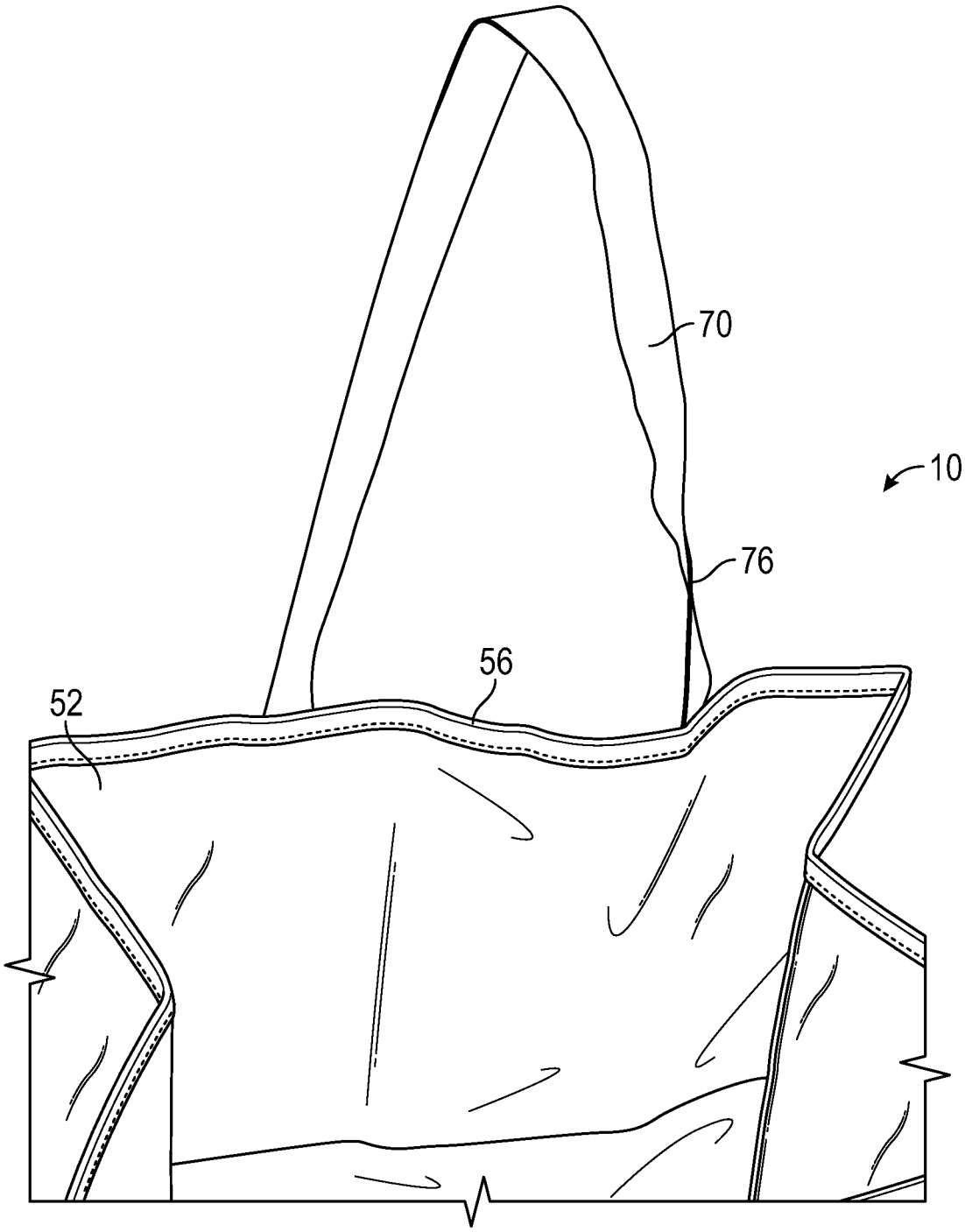
FIG. 11 is a side elevation view of one of the pair of handles of an example embodiment illustrating a twist disposed therein to enable securement of the handle around the folded stack with the handle lain flush against the stack.
Figure 12:
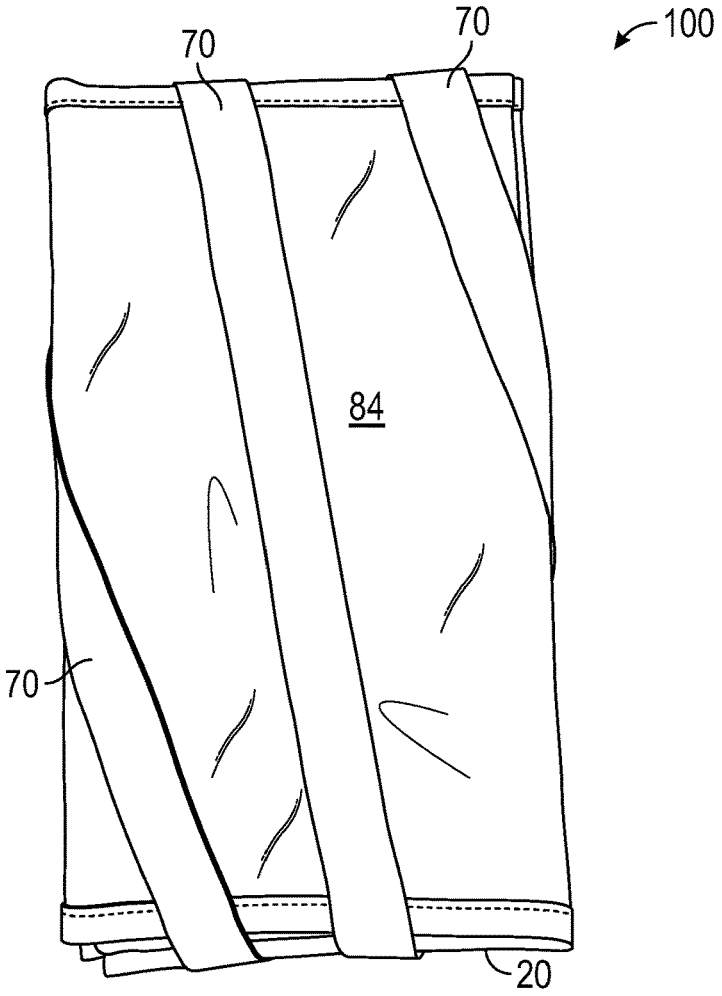
FIGS. 12 to 17 illustrate an example embodiment of the compactible reusable shopping bag secured in a folded stack by engagement of a pair of handles engaged diagonally around the folded stack.
Figure 13:
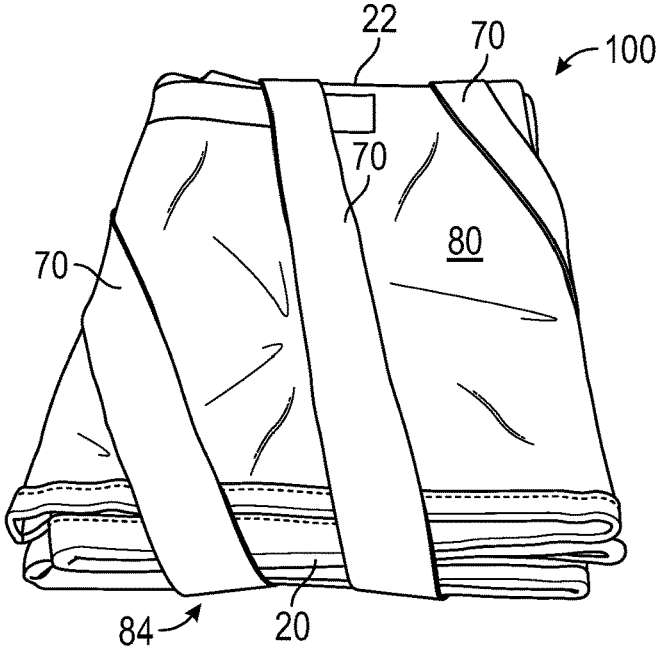
Figure 14:
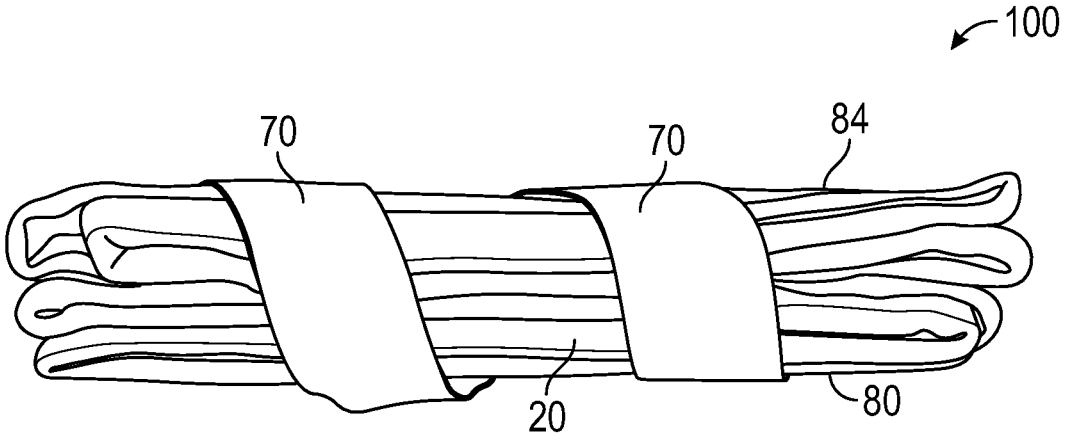

FIG. 1 illustrates the present compactible reusable shopping bag 10 in an elevation view. The pair of handles 70 are shown suspended within the interior space 24. Thus FIG. 1 can be interpreted to depict an example embodiment where the pair of handles 70 are connected either in the transverse orientation (as shown in FIG. 2) or the longitudinal orientation (as shown in FIG. 10). FIG. 1 therefore depicts an example embodiment illustrating the features of the bag 10 common to multiple example embodiments. The handles 70 and handle loops 72 are disposed attached at the open top 22 to a reinforced topmost seam 56 disposed to strengthen the connection thereat.

FIG. 1 further illustrates a first vertical fold 60 and a second vertical fold 62 disposed upon the visible longitudinal side 52 that divide the longitudinal side 52 into thirds—a first third 80, a central third 82, and a final third 84. Ends of the handles 70 are attached to the topmost seam 56 approximate the first vertical folds 60 and second vertical folds 62 of each said longitudinal side 52.

Figure 7:
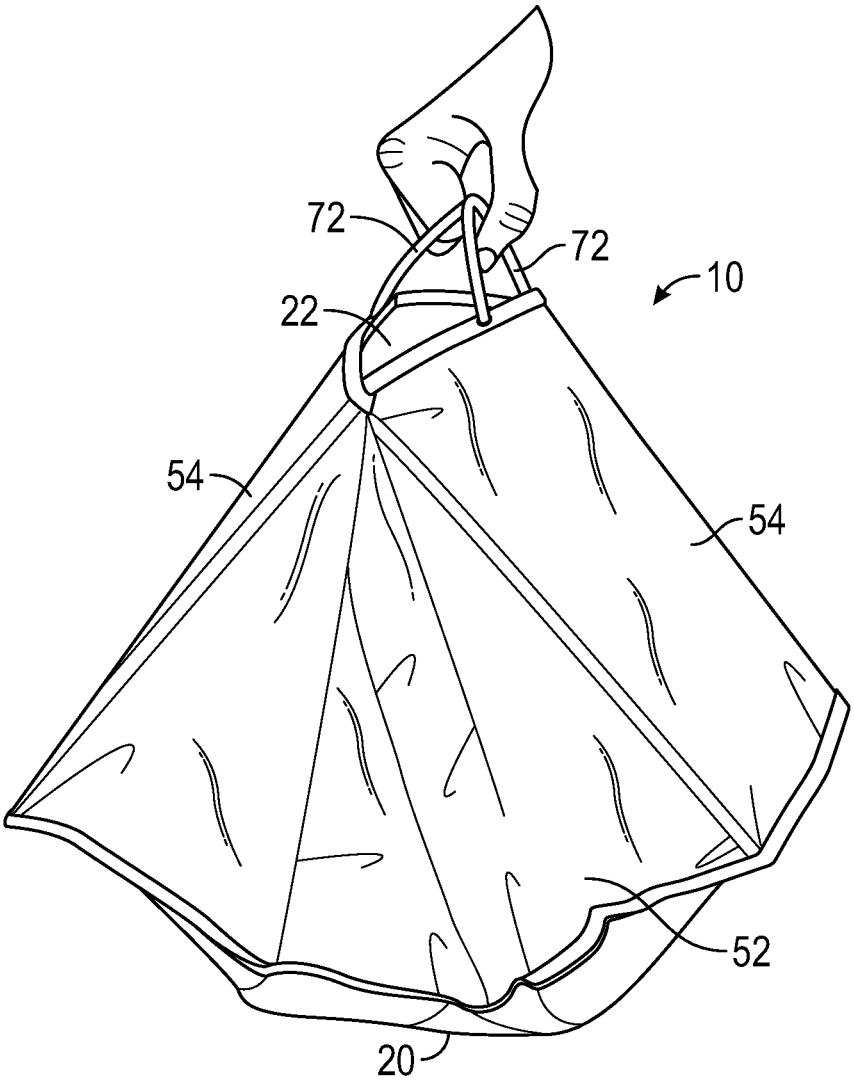
FIG. 7 is an elevation in-use view of an example embodiment being carried by a pair of handle loops instead of by the pair of handles, useful for porting fewer items in an interior space.
Figure 26:
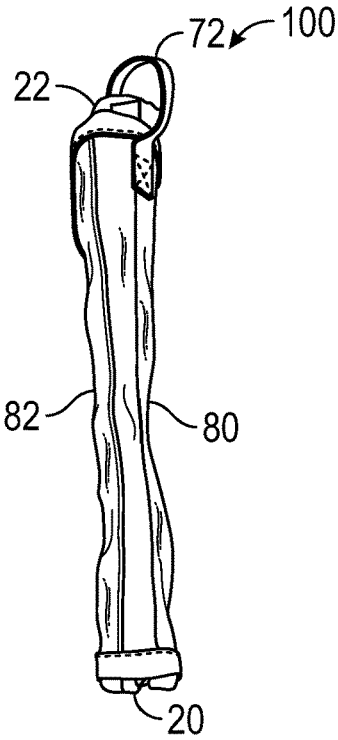
Figure 27:
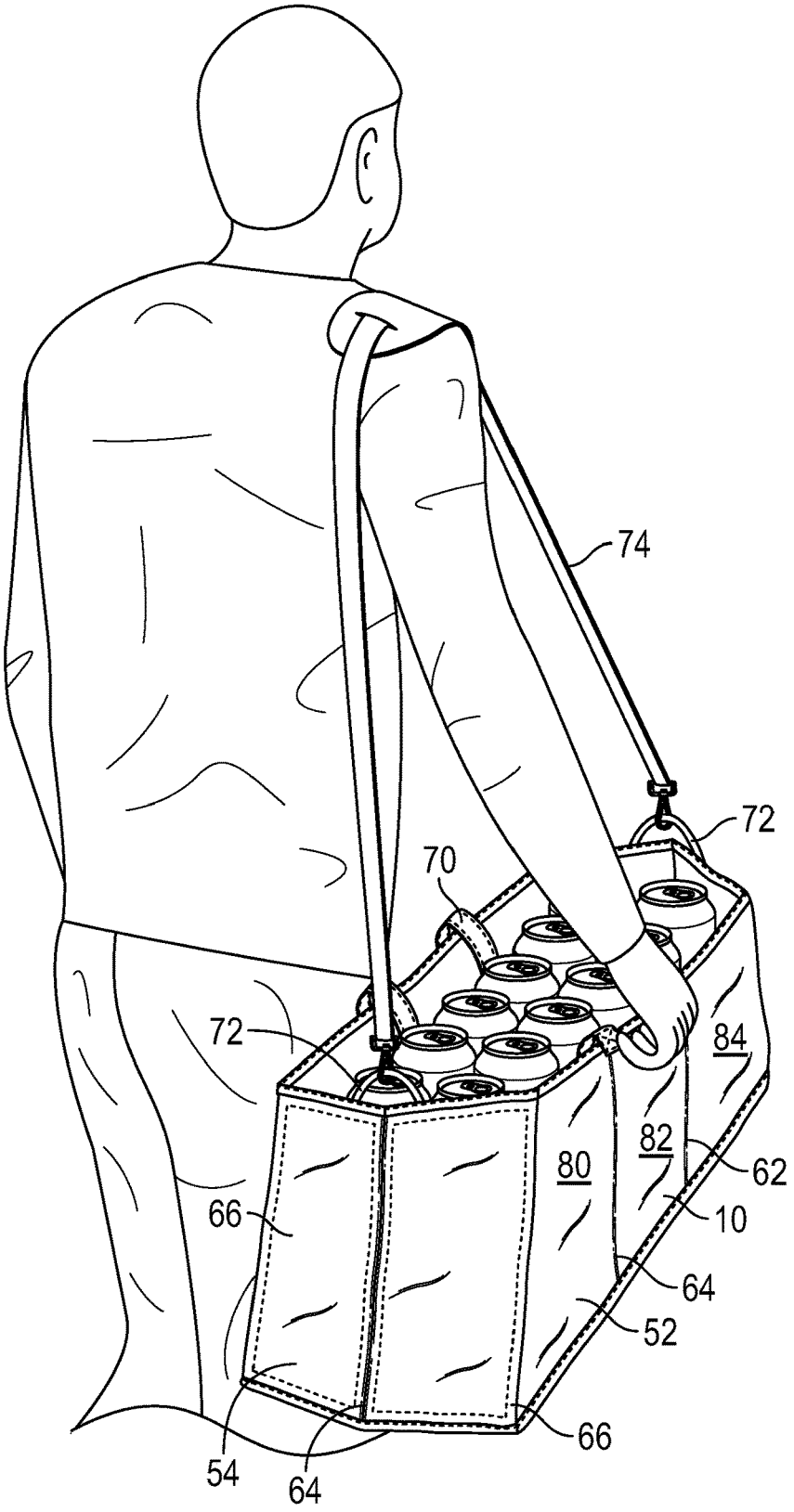
FIG. 27 illustrates an example embodiment in-use and ported by means of a shoulder strap attached to each of a pair of handle loops disposed upon the transverse sides.

FIG. 2 illustrates a top elevation view with the pair of handles 70 disposed in the transverse orientation. The interior space 24 is visible enclosed by the plurality of sides 50. The vertical fold 64 bisecting each transverse side 54 is visible. Reinforcing elements 66, disposed upon or within each transverse side 54, are shown in dotted lines. Handle loops 72 on the transverse sides 54 enable portage, where desirable, as shown in FIG. 7 or by interconnection with shoulder strap 74, as shown in FIG. 26.

FIG. 3 is a side elevation view depicting the compactible reusable shopping bag 10 with the transverse sides 54 folded inwards and the bag 10 collapsed to place the longitudinal sides 52 proximate to each other. Each transverse side 54 is two-thirds the size of each longitudinal side 52 whereby the folded transverse sides 54, folded inwards, present an area one-third the size of each longitudinal sides 52. Thus, one of the transverse sides 54 occupies an area in between the first third 80 of each longitudinal side 52 and the other of the transverse sides 54 occupies an area in between the final third 84 of each of the longitudinal sides 52. The central third 82 of each longitudinal side 52 is therefore rendered approximate each other. The reinforcing elements 66 disposed in or upon each transverse side 54 therefore present a stiff basis within each of the first third 80 and the final third 84 for purchase in effectuating folding of the bag 10, as well as providing a basis around which the handles 70 engage, as shown in FIG. 4.

FIGS. 4 through 6 show the compactible reusable shopping bag 10 disposed in the folded stack 100. Due to the handles' 70 orientation, the stack 100 here depicted was folded in a Z-fold. Each of the pair of handles 70 presents one end on the outside of the folded stack 100 and the other end within the folded stack 100. Each handle 70 is thence invertible to tautly secure around the stack 100 folded bottom in the manner shown in FIG. 5. Because one end of each handle 70 is disposed interior to the folded stack 100, the top 22 of the folded stack 100 is likewise enwrapped between each handle 70 (see for example FIG. 6). This arrangement ensures the stack 100 is secured at both top 22 and bottom 20 by the handles 70.

FIG. 8 illustrates the manner of forming the folded stack 100 by action of a Z-fold. The bag 10 is first collapsed by folding the transverse sides 54 inwards along the vertical fold 64 to bring each of the longitudinal sides 52 together. The final third 84 of the longitudinal sides 52 is then folded in a first direction to overlie the central third 82. Then the first third 80 is folded in a second direction opposite the first direction to position the first third 80 overlying the other side of the central third 82. The handles 70 are then inverted to engage around the stack 100.

Figure 9:
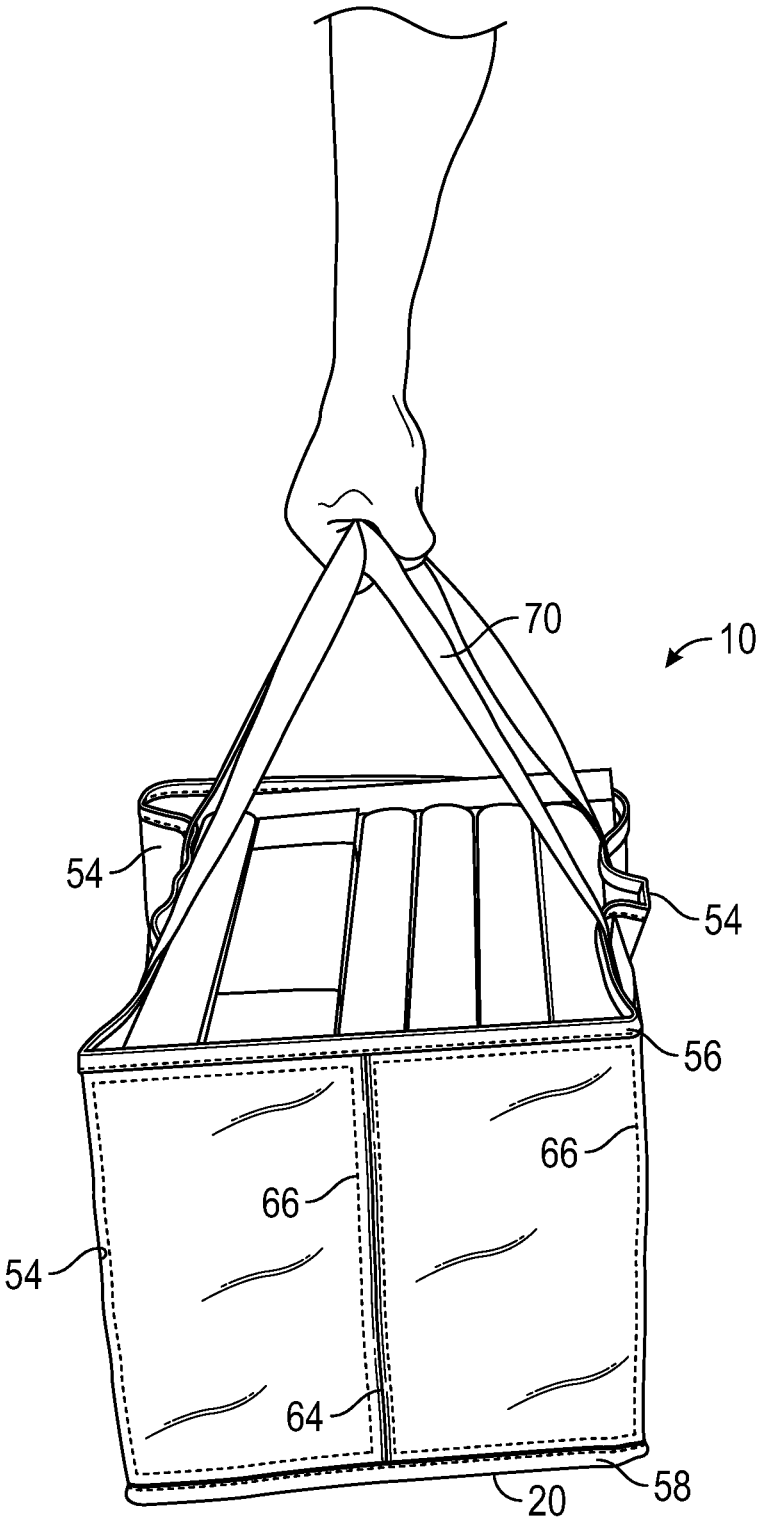
FIG. 9 is an in-use elevation view of an example embodiment illustrating the pair of handles disposed in a longitudinal orientation.

FIG. 9 illustrates an in-use view of an example embodiment of the present compatible reusable shopping bag 10 with the pair of handles 70 disposed in the longitudinal orientation. In this example embodiment, the bag 10 is filled with books to illustrate the capacity and strength of the bag 10 despite its lightweight and compactible materials. Reinforced lowermost seam 58 reduces the possibility of separation of the plurality of sides 50 from the bottom 20 and reinforced topmost seam 56 strengthens the securement of the handles 70 in place at the open top 22 of each longitudinal side 52 thereby ensuing durability over repeated use porting heavy loads (as depicted).

FIG. 10 illustrates an elevation view of an example embodiment of the present compactible reusable shopping bag 10 with the handles 70 in the longitudinal orientation. In this embodiment, a twist 76 is illustrated in the handle 70 to enable flush fitting of the handles 70 secured around the folded stack 100 when folded in a Z-fold (also shown in FIG. 11). It should be noted that this twist 76 is not necessary to all embodiments of the invention 10 contemplated herein, such as, for example, when the bag 10 is folded via a U-fold, for example, or where fasteners are used to secure the stack 100 additionally to the handles 70, as shown in FIGS. 18 through 25, for example, or where the handles 70 are disposed in the transverse configuration.

FIGS. 12 through 17 illustrate securement of the folded stack 100 where each of the pair of handles 70 is disposed in the longitudinal orientation. The handles 70 secure diagonally around the stack 100 and engage at the folded bottom 20 proximal a corner of the stack 100. As set forth hereinabove, where a Z-fold is used to fold the bag 10 into the stack 100, the handles 70 may include a twist 76 (see for example FIG. 11). This twist 76 allows the handles 70 to press flush against both sides of the folded stack 100 and accommodates engagement around the bottom 20 of the folded stack 100 without the handles 70 crimping or presenting a twist as would otherwise occur absent inclusion of the twist 76. See for example FIGS. 12, 13, and 14. As set forth above, this twist 76 is not necessary to all embodiments.

Figure 15:
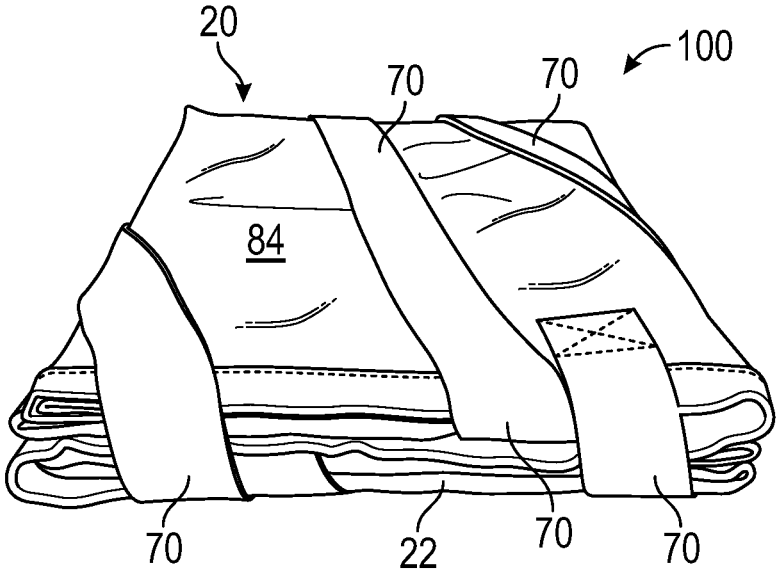
Figure 16:
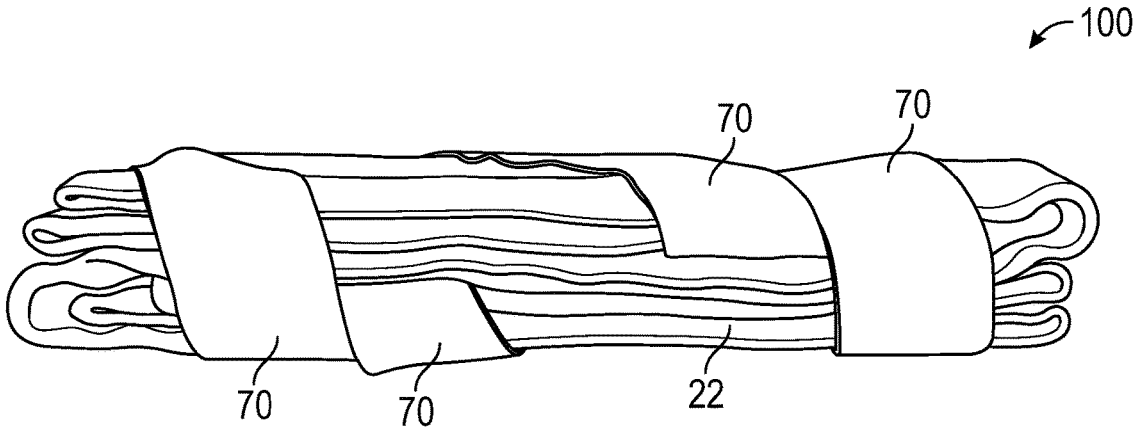
Figure 17:
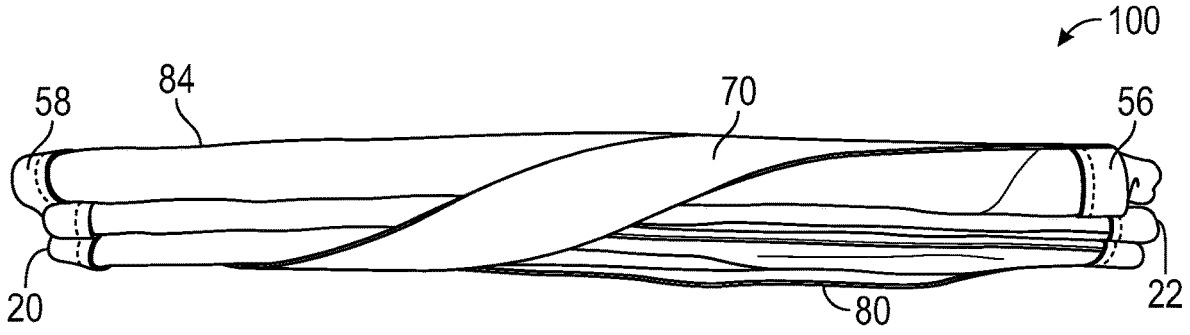

As shown in FIGS. 15, and 16, the top 22 of the folded stack 100 is secured enwrapped by the pair of handles 70; one end of each handle 70 is disposed within the folded stack 100, and the other is disposed on the outside of the folded stack 100. Thus, each handle 70 secures overtop of at least half of the top 20 of the stack 100. As shown in FIG. 17, this embodiment further enables wrapping of each handle 70 around sides of the folded stack 100.

FIGS. 18 through 26 illustrate an example embodiment of the present invention 10 securable in the folded stack 100 by action of fasteners 90, 92 disposed to secure around sides of the folded stack 100. In the example embodiment depicted, the fasteners 90, 92 are contemplated to be hook and loop fasteners and fastening receiving elements, however additional and other fastening elements are contemplated as within scope of the invention 10. In the embodiment depicted, the stack 100 is formed by effectuating a U-fold and then securing the stack 100 by engaging each fastener 90, 92 to a corresponding fastening receiving element 94, 96. It should be noted that the position of the fasteners 90, 92 and the fastening receiving elements 94, 96 may vary between embodiments, such as where the stack 100 is formed by action of a Z-fold, for example. Thus, the present explanation given in regard to FIGS. 18 through 26 herein is exemplary and not necessarily definitive or intended to be exclusionary.

Figure 18:
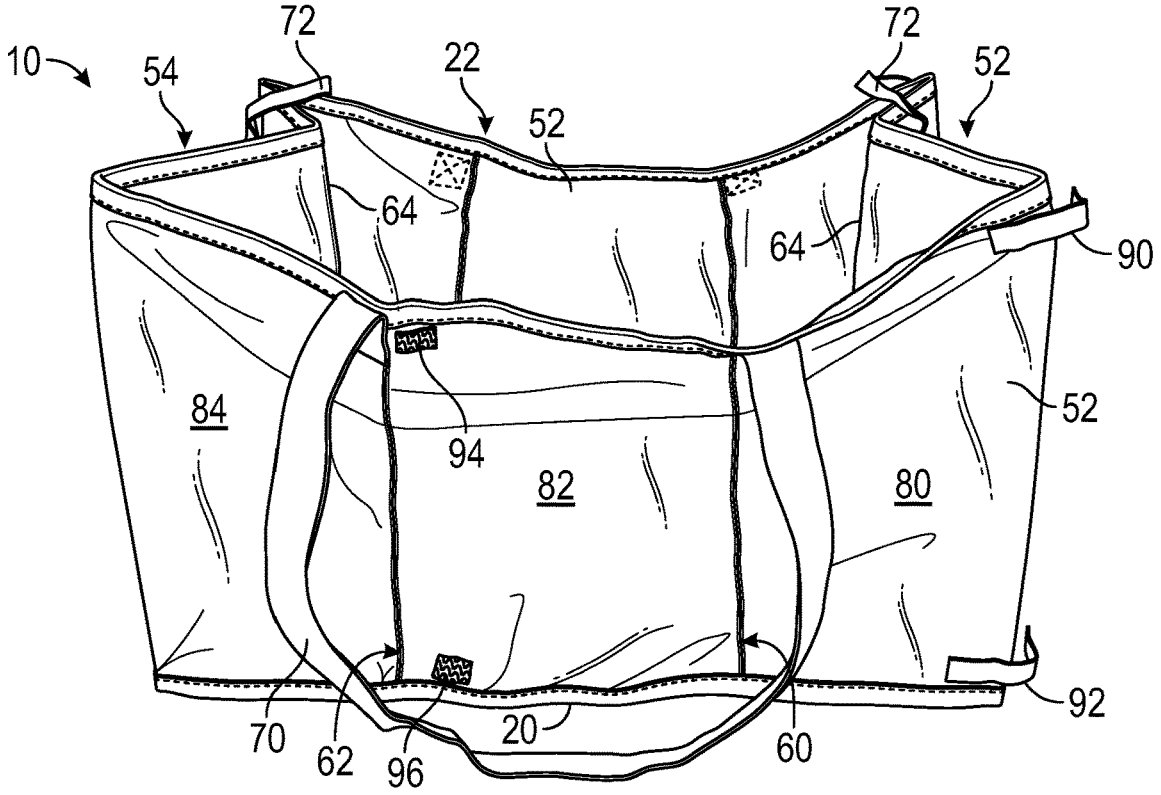
FIGS. 18 to 26 illustrate an example embodiment of the compactible reusable shopping bag folded in a U-fold for securement in the folded stack by action of a first and second fastener.
Figure 19:
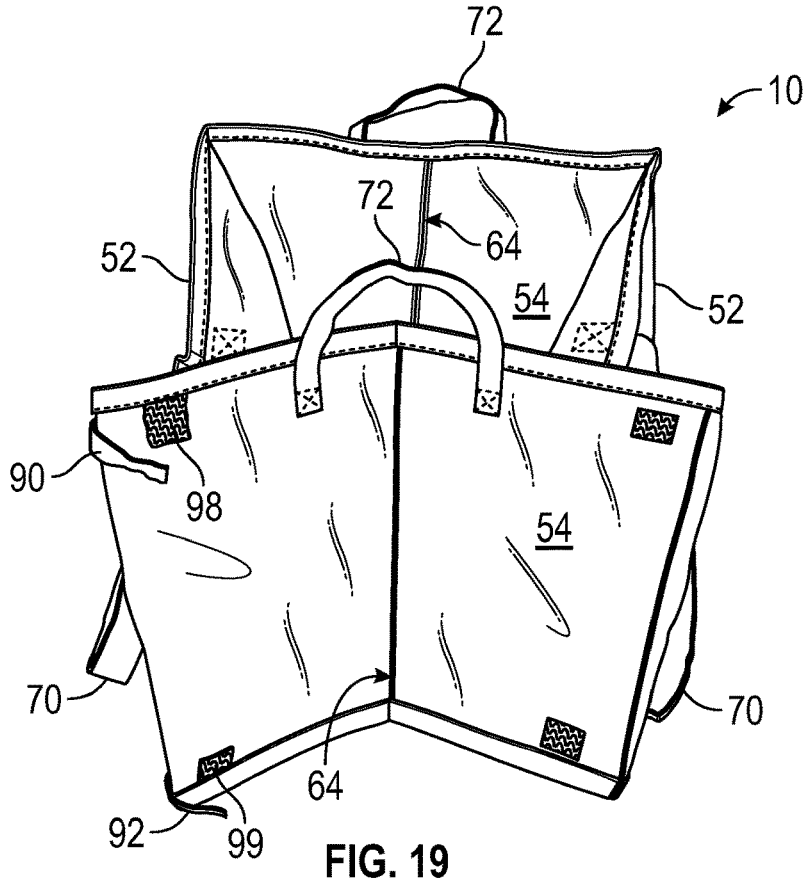
Figure 20:
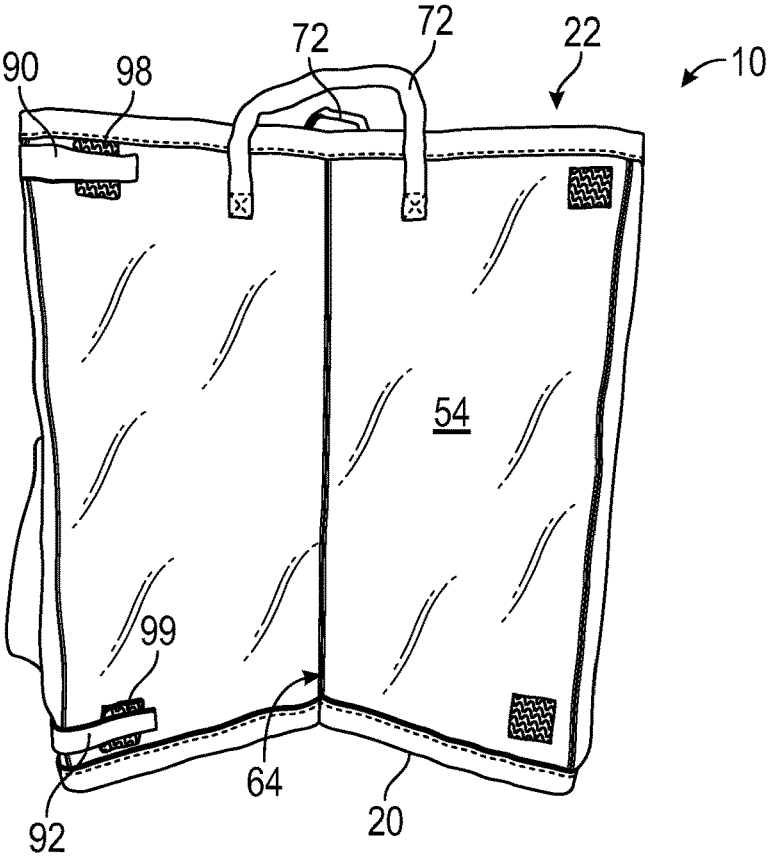
Figure 21:
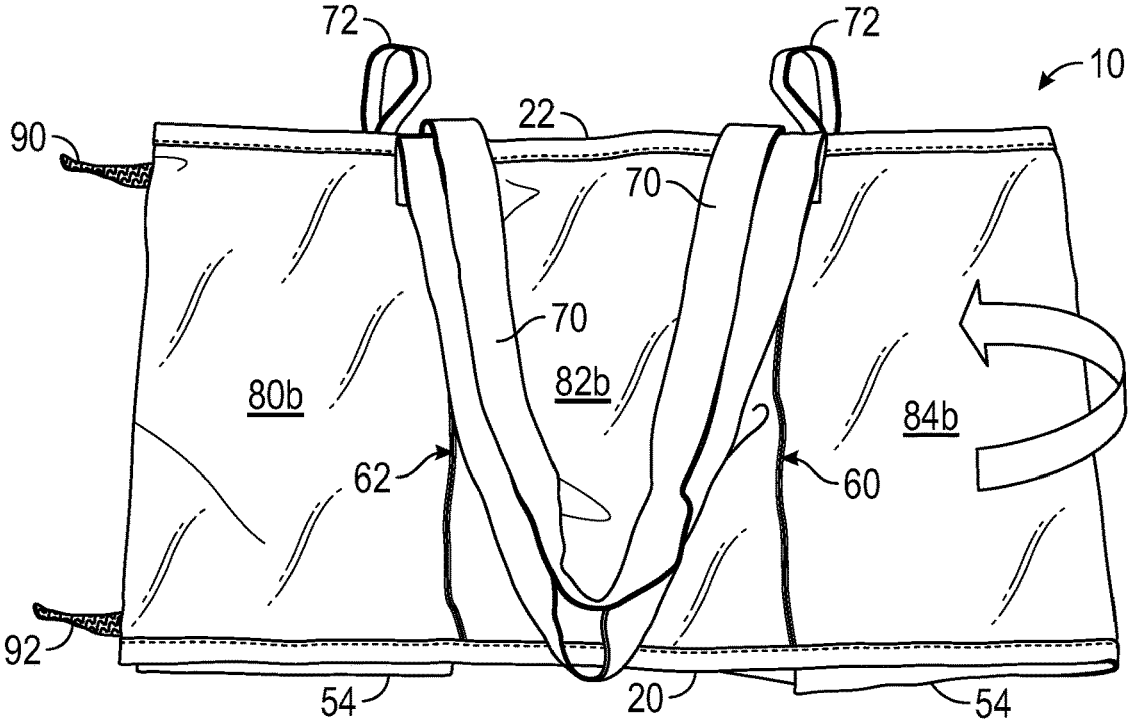
Figure 22:
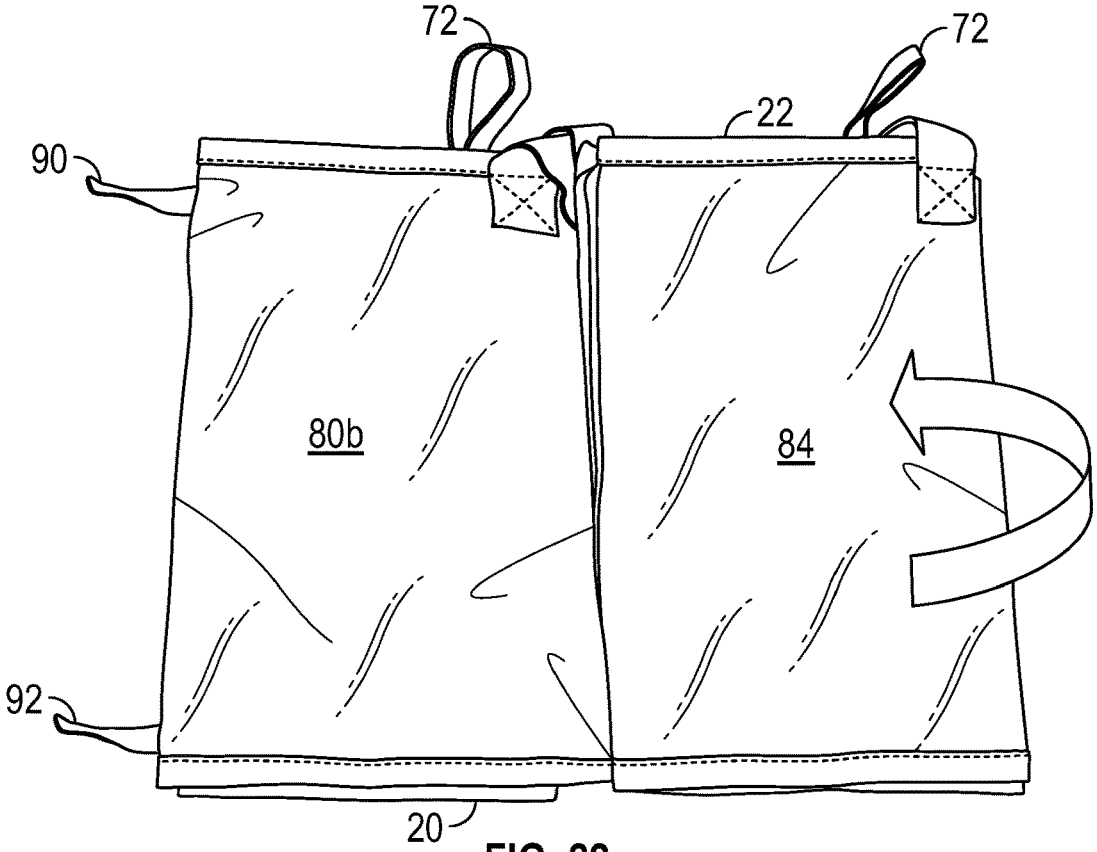
Figure 23:
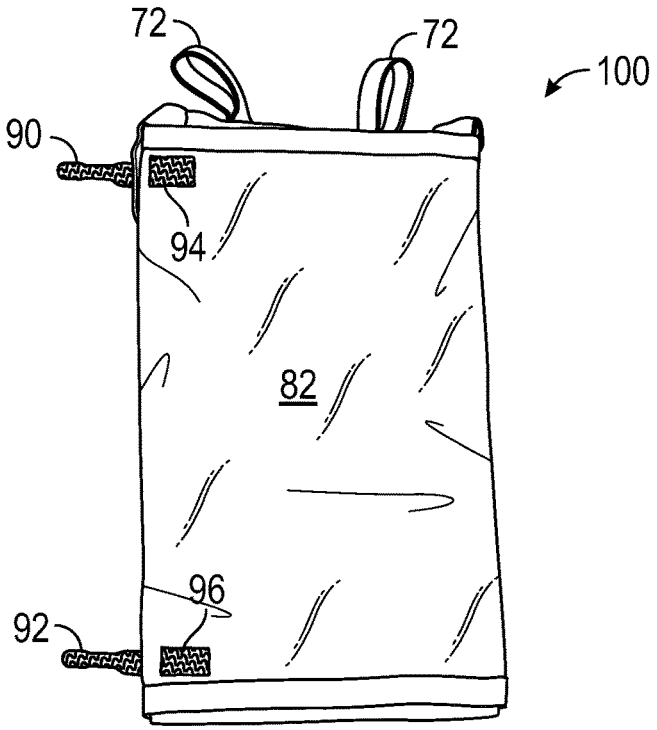
Figure 24:
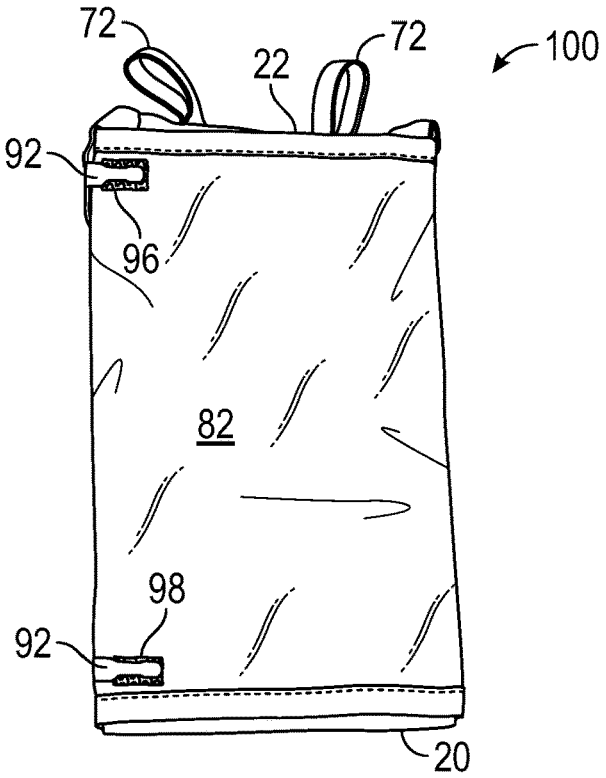

A first fastener 90 and a second fastener 92 are disposed upon the first third 80 of one of the longitudinal sides 52 approximate the juncture with the corresponding transverse side 54. The first fastener 90 is disposed proximal the open top 22, the second fastener 92 is disposed proximal the bottom 20. As best shown in FIGS. 18, 21, and 22, each of the first and second fasteners 90, 92 is disposed to project a portion overhanging the associated transverse side 54. When the bag 10 is in the expanded position for use, the first and second fastener 90, 92 may be stowed engaged to receiving elements 98 and 99 disposed upon the associated transverse side 54 (see for example FIGS. 19 and 20).

A first fastening receiving element 94 is disposed upon the longitudinal side 52 coaxial with the first fastener 90 on the central third 82 proximal the second vertical fold 62. A second fastening receiving element 96 is likewise disposed upon the longitudinal side 52 on the central third 82 proximal the second vertical fold 62 and coaxial with the second fastener 92. When the bag 10 is folded to the stack 100 by action of a U-fold, the first and second fastening receiving elements 94, 96 are thus positioned proximal to the first and second fastening elements 90, 92 which are readily attachable thereto to secure the folded stack 100 together. In the example embodiment depicted, the handles 70 are placed upon the central third 82 before the first and final thirds 80, 84 are folded atop one another, thereby stowing the handles 70 interior to the stack 100. Alternatively, the handles 70 may be secured round the stack 100 as in previously discussed embodiments.

Figure 25:
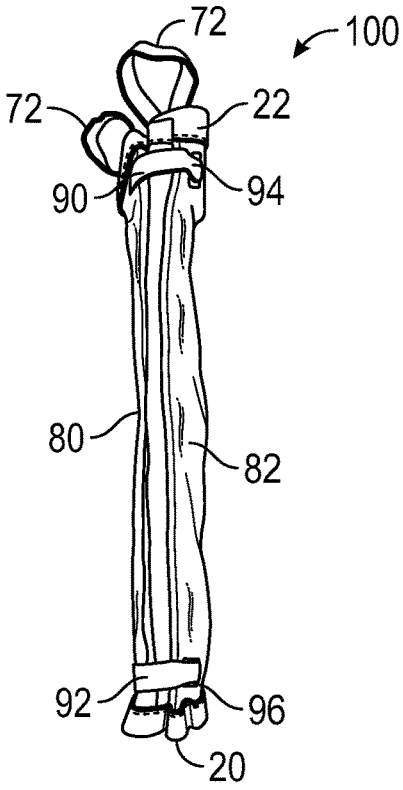

Thus, to present the folded stack 100, the bag is first collapsed by folding in the transverse sides 54 as in the previous embodiments. With the other longitudinal side 52*b* facing the user, the final third 84*b* is folded inwards to overlie the central third 82*b*. First third 80*b* is thence folded atop final third 84*b*. Outer surfaces of the folded stack now comprise longitudinal side 52, and first third 80 and central third 82. This U-fold thus places fasteners 90 and 92 proximally to fastening receiving elements 94 and 96. Fasteners 90 and 92 thus secure over the side of the stack 100 to secure the stack 100 in the folded position. FIG. 25 illustrates edge of the stack 100 secured by the fasteners 90 and 92. FIG. 26 shows the other edge of the folded stack 100, which is the first vertical fold 60 of the bag 10.

What is claimed is:

1. A compactible reusable shopping bag collapsible to a folded stack from an expanded position, said compactible reusable shopping bag comprising:

a bottom;

an open top;

a plurality of sides perimetrically disposed upon the bottom to surround an interior space, said plurality of sides having an outside surface, an inside surface, and a height, said plurality of sides further comprising:

a pair of longitudinal sides, each of said pair of longitudinal sides having:

a first third;

a central third;

a final third;

a first vertical fold disposed between the open top and the bottom between the first and central third;

a second vertical fold disposed between the central third and the final third;

a pair of transverse sides, each of said pair of transverse sides having:

each of a pair of planar reinforcing elements disposed at either side of a vertical fold, said vertical fold disposed bisecting each transverse side from the open top to the bottom;

a pair of handles disposed upon the pair of longitudinal sides at the open top; and each of a pair of handle loops disposed upon one of the pair of transverse sides at the open top;

wherein the compactible reusable shopping bag is foldable to a compact, storable, and portable size by first folding each transverse side in half inwardly towards the interior space such that the inside surface of each transverse side is caused to contact the inside surface of each longitudinal side, and then folding the pair of longitudinal sides at the first vertical fold and then folding the pair of longitudinal sides at the second vertical fold, to present a compact stack.

2. The compactible reusable shopping bag of claim 1 wherein the pair of handle loops is usable to port the bag by bringing the pair of transverse sides together, for porting fewer items within the interior space, and alternatively, by means of a shoulder strap connected to the pair of handle loops to enable over-the-shoulder portage of the bag.

3. The compactible reusable shopping bag of claim 2 wherein the transverse sides are two-thirds the length of the longitudinal sides whereby folding one of the pair of transverse sides inwards presents the vertical fold therein conjunct the first vertical fold of the pair of longitudinal sides and whereby folding the other of the pair of transverse sides in like manner presents the vertical fold therein conjunct the second vertical fold of the pair of longitudinal sides, whereby folding the longitudinal sides at each of the first and second vertical folds positions each folded transverse side atop one another and the folded stack is one-third the area of one of the pair of longitudinal sides.

4. The compactible reusable shopping bag of claim 3 wherein the pair of handles have a first length approximately the same length as the height of the plurality of sides wherein the folded shopping bag is compactly securable in the folded position by securing the pair of handles engaged around the folded bottom of the stack.

5. The compactible reusable shopping bag of claim 4 wherein the plurality of sides further comprises an upper edge bounding the open top, said upper edge reinforced with a topmost seam.

6. The compactible reusable shopping bag of claim 5 wherein the plurality of sides further comprises a lower edge conjoined with the bottom, said lower edge reinforced with a lowermost seam.

7. The compactible reusable shopping bag of claim 6 wherein the bag is made of a polymeric fabric such as silnylon, polyester coated with polyurethane, or polyethylene, or of a laminated woven sheet material.

8. The compactible reusable shopping bag of claim 7 wherein each of the pair of handles is disposed in a transverse orientation, endwise connected to each of the pair of longitudinal sides at the open top in parallel with the transverse sides.

9. The compactible reusable shopping bag of claim 8 wherein one of the pair handles is connected to each of the longitudinal sides atop the first third proximal the first vertical fold, and the other of the pair of handles is connected to each of the longitudinal sides atop the final third proximal the second vertical fold.

10. The compactible reusable shopping bag of claim 7 wherein each of the pair of handles is disposed in a longitudinal orientation endwise connected to one of the pair of longitudinal sides at the open top in parallel with each said longitudinal side.

11. The compactible reusable shopping bag of claim 10 wherein one of the pair of handles is connected to one of the longitudinal sides atop the first third proximal the first vertical fold and the final third proximal the second vertical fold, and the other of said pair of handles is connected to the other of the longitudinal sides atop the first third proximal the first vertical fold and the final third proximal the second vertical fold.

12. The compactible reusable shopping bag of claim 9 wherein the pair of handles invert to secure the bag in the folded position by engagement around the bottom edge of the stack.

13. The compactible reusable shopping bag of claim 9 wherein the pair of handles secure the bag in the folded position by wrapping diagonally around the stack to engage cornerwise at the bottom edge.

14. The compactible reusable shopping bag of claim 3 wherein the first vertical fold is foldable in a first direction and the second vertical fold is foldable in a second direction opposite the first direction whereby the bag is foldable to the stack position by action of a Z-fold.

15. The compactible reusable shopping bag of claim 3 wherein the first vertical fold is foldable in the same direction as the second vertical cold whereby the bag is foldable to the stack by action of a U-fold.

16. The compactible reusable shopping bag of claim 7 wherein the reinforcing elements are polyethylene boards.

17. The compactible reusable shopping bag of claim 3 wherein the bag is reversible and usable inside-out.

18. The compactible reusable shopping bag of claim 3 wherein the bag is machine washable.

19. The compactible reusable shopping bag of claim 3 wherein the bag further comprises:

a first fastener disposed upon the first third of one of the longitudinal sides proximal the open top and one of the pair of transverse sides;

a second fastener disposed upon the first third of the same longitudinal side as the first fastener, said second fastener disposed proximal the bottom;

a first fastening receiving element disposed upon the same longitudinal side as the first and second fasteners, said first fastening receiving element disposed upon the central third proximal the second vertical fold coaxial with the first fastener and connectable thereto; and a second fastening receiving element disposed upon the same longitudinal side as the first and second fasteners, said second fastening receiving element disposed upon the central third proximal the second vertical fold coaxial with the second fastener and connectable thereto;

wherein the compactible reusable shopping bag is securable in the folded stack by securement of the first fastener to the first fastening receiving element and by securement of the second fastener to the second fastening receiving element.

* * * * *